US008051778B2

(12) United States Patent
Österle

(10) Patent No.: US 8,051,778 B2
(45) Date of Patent: Nov. 8, 2011

(54) CHAIR FOR A CHAIR LIFT AND CHAIR LIFT

(75) Inventor: Manfred Österle, Sulzberg (AT)

(73) Assignee: Innova Patent GmbH, Wolfurt (AT)

( * ) Notice: Subject to any disclaimer, the term of this patent is extended or adjusted under 35 U.S.C. 154(b) by 90 days.

(21) Appl. No.: 12/572,594

(22) Filed: Oct. 2, 2009

(65) Prior Publication Data

US 2010/0089277 A1 Apr. 15, 2010

(30) Foreign Application Priority Data

Oct. 9, 2008 (AT) ..... A1587/2008

(51) Int. Cl.
*B61C 13/00* (2006.01)

(52) U.S. Cl. ..... 105/149.2; 297/232; 105/149.1

(58) Field of Classification Search ..... 105/149.1, 105/149.2; 297/466, 467, 487, 488
See application file for complete search history.

(56) References Cited

U.S. PATENT DOCUMENTS

| | | | | |
|---|---|---|---|---|
| 3,353,503 | A * | 11/1967 | Pettit | 105/150 |
| 3,702,034 | A * | 11/1972 | Pfeiffer | 40/320 |
| 5,664,499 | A * | 9/1997 | Kingsmill | 104/28 |
| 6,287,211 | B1 * | 9/2001 | Bolliger et al. | 472/43 |
| 6,427,601 | B2 * | 8/2002 | Albrich | 104/87 |
| 6,520,573 | B2 * | 2/2003 | Osterle | 297/184.11 |
| 6,691,624 | B2 * | 2/2004 | Albrich | 105/149.2 |
| 6,840,179 | B2 * | 1/2005 | Begotti | 105/346 |
| 7,002,319 | B2 * | 2/2006 | Hinteregger | 320/110 |
| 7,204,559 | B2 * | 4/2007 | Berra | 297/466 |
| 7,255,396 | B1 * | 8/2007 | Anikin | 297/284.9 |
| 7,677,671 | B2 * | 3/2010 | Steininger et al. | 297/488 |
| 7,690,313 | B2 * | 4/2010 | Sutter et al. | 104/117.1 |
| 7,802,523 | B2 * | 9/2010 | Moritzhuber et al. | 104/173.1 |
| 2002/0007758 | A1 * | 1/2002 | Albrich | 104/89 |
| 2002/0070599 | A1 * | 6/2002 | Berra | 297/466 |
| 2003/0006639 | A1 * | 1/2003 | Shimizu | 297/423.17 |
| 2003/0136298 | A1 * | 7/2003 | Albrich | 105/329.1 |
| 2006/0232119 | A1 * | 10/2006 | Hinteregger | 297/487 |
| 2007/0095244 | A1 * | 5/2007 | Sutter et al. | 104/112 |
| 2007/0221088 | A1 * | 9/2007 | Hinteregger | 104/178 |
| 2008/0150346 | A1 * | 6/2008 | Hinteregger | 297/488 |
| 2009/0058170 | A1 * | 3/2009 | Switzeny | 297/487 |
| 2009/0151594 | A1 * | 6/2009 | Dur et al. | 104/112 |
| 2010/0089276 | A1 * | 4/2010 | Fischnaller | 105/149.2 |
| 2010/0089277 | A1 * | 4/2010 | Osterle | 105/149.2 |
| 2010/0089278 | A1 * | 4/2010 | Sutter | 105/149.2 |
| 2010/0089279 | A1 * | 4/2010 | Sutter | 105/149.2 |
| 2010/0089280 | A1 * | 4/2010 | Sutterluty | 105/149.2 |
| 2010/0089281 | A1 * | 4/2010 | Sutter | 105/149.2 |

FOREIGN PATENT DOCUMENTS

| | | |
|---|---|---|
| AT | 411 046 B | 9/2003 |
| AT | 411 523 B | 2/2004 |

* cited by examiner

*Primary Examiner* — Joe Morano, IV
*Assistant Examiner* — Jason C Smith
(74) *Attorney, Agent, or Firm* — Laurence A. Greenberg; Werner H. Stemer; Ralph E. Locher

(57) ABSTRACT

A chair for a chair lift has seats with a seat surface and a safety bar that extends transversely over the seats and can be pivoted from an open position into a closed position. Securing parts, in particular protective panels, are arranged on the safety bar and, in the closed position of the safety bar, extend in the direction toward the center of the front edge of the respective seat surface. The securing parts have a first section which is adjacent to the safety bar and is oriented toward the front edge, and a second end section which is oriented at an angle of less than 180° to the first section.

23 Claims, 3 Drawing Sheets

CHAIR FOR A CHAIR LIFT AND CHAIR LIFT

CROSS-REFERENCE TO RELATED APPLICATION

This application claims the priority, under 35 U.S.C. §119, of Austrian patent application A 1587/2008, filed Oct. 9, 2008; the prior application is herewith incorporated by reference in its entirety.

BACKGROUND OF THE INVENTION

Field of the Invention

The invention relates to a chair of a chair lift having seats with a seat surface and with a safety bar which extends transversely over the seats and can be pivoted from an open position into a closed position, wherein securing parts, in particular protective panels, are arranged on the safety bar and, in the closed position of the safety bar, extend in the direction toward the center of the front edge of the respective seat surface. The invention furthermore relates to a chair lift with chairs of this type.

Chairs for chair lifts have at least one seat, generally up to eight or more, for example ten, seats located next to one another. In order to prevent the passengers from falling out from or slipping off the chair, said chairs have safety bars which go over the entire width of the chair. Said safety bars can be pivoted from a position in which they are located above the passengers (open position) into a position in which a crossbar moves in front of the passengers and over their thighs (closed position). In addition, footrests are also frequently provided on the safety bars.

Since, in accordance with the regulations, the distance between the safety bar and seat surface is dimensioned in such a manner that even tall passengers having longer legs have a comfortable amount of space under the safety bar, said distance is generally too large for shorter people, and therefore said shorter people may slip through under the crossbar, in particular if, due to their shorter legs, they cannot support their feet on the footrests. In order to reduce this slipping-through risk for smaller people, it is known from commonly assigned U.S. Pat. No. 6,691,624 B2 and its counterpart Austrian patent AT 411 523 B and from Austrian patent AT 411 046 B. to arrange securing parts, in particular protective panels, on the safety bars, said securing parts, in the closed position of the safety bar, extending in the direction toward the center of the front edge of the respective seat surfaces. After the safety bar has been pivoted into the closed position thereof, said securing parts are located between the passengers' thighs.

The known protective panels are substantially triangular with a rounded end in order to avoid injuring passengers. One problem which may occur in this case is that, when the safety bar is closed, the securing part may push or press against a body part, for example against a passenger's thigh, if the passenger is not seated in the correct position on the seat. A further problem is that, when the safety bar is closed, the securing part, should it come into contact with the passenger, may become caught on his helmet in the area of the nape of his neck, which may result in direct risks of injury and to diverse consequential risks.

SUMMARY OF THE INVENTION

It is accordingly an object of the invention to provide a chair lift chair and a chair lift with such chairs, which overcome the above-mentioned disadvantages of the heretofore-known devices and methods of this general type.

With the foregoing and other objects in view there is provided, in accordance with the invention, a chair of a chair lift, comprising:

a plurality of seats with a seat surface having a front edge;

a safety bar pivotally mounted between an open position and a closed position wherein said safety bar extends transversely across said seats;

a plurality of securing parts, such as protective panels or cams, mounted to said safety bar and, in the closed position of said safety bar, extending in a direction toward a center of said front edge of a respective said seat surface;

said securing parts having a first section adjacent said safety bar and oriented toward said front edge, and a second section distal from said safety bar and enclosing an angle of less than 180° with said first section.

In other words, the objects of the invention are achieved in that the securing parts have a first section which is adjacent to the safety bar and is oriented toward the front edge, and a second end section which is oriented at an angle of less than 180° to the first section.

Owing to the fact that the end section of the securing part is oriented at an angle of less than 180° in relation to the section facing the safety bar, it is no longer that end of the securing part which is pointed to a greater or lesser degree which comes into contact with the passenger, but rather a contact zone over a relatively large surface area is provided, as a result of which injury or at least painful contact with the securing part can be substantially avoided. It is furthermore particularly advantageous that, when the safety bar is closed, should there be possible contact with the passenger, the securing part cannot become caught on his helmet in the area of the nape of his neck, since the securing part, owing to its configuration according to the invention, then slides away from the helmet.

In a preferred embodiment of the invention, said invention is characterized in that the first section has a first surface facing the seat, and the end section has a second surface facing the seat. The first surface and the second surface, as seen from the opposite side (i.e., away from the seat and the passengers), are oriented at an angle of less than 180° to each other. The angle is preferably between 90° and 160°, and very particularly preferably between 110° and 140°.

If the angle of the second surface located on the end section lies within the preferred angular range, a large contact surface is provided in the event of contact with a passenger's thigh, thus making it possible to substantially avoid unpleasant or painful contact.

Of course, the stated angles are dependent on how the first section arranged on the safety bar is oriented toward the seat or the seat surface. What matters importantly is that the potential contact surface of the end section of the securing part with a passenger's thighs or another body part is over as large a surface area as possible, which is achieved according to the invention by the angled portion.

The first section and the end section can be connected to each other via a central section which is either arcuate or has a kink, the edges of the kink preferably being rounded.

Both that surface of the end section which faces the passenger or seat and that of the first section and, if appropriate, of a central section, if one is present, may either be substantially plane or curved, as viewed in the longitudinal extent of the securing part. It is also conceivable for the surface of one section to be planar or approximately planar and for the other surface to be curved. It is furthermore conceivable for all of those surfaces of the sections which face the seat to have a common, continuous or discontinuous curvature passing therethrough.

In a preferred embodiment of the invention, the chair according to the invention can have separating elements rising over the seat surfaces between the seat surfaces. The separating elements cause a passenger to notice immediately if he is sitting in the transition region from one seat to an adjacent seat. He will then immediately correct his sitting position before the safety bar is pivoted into its closed position. The passenger's legs are then automatically in a position in which undesirable collisions with the securing part are largely avoided.

In comparison to the securing parts known from the prior art, in particular protective panels, the width of the securing part according to the invention, is measured parallel to the front edge of the seats, can be kept very small in order to ensure more leg room overall.

Other features which are considered as characteristic for the invention are set forth in the appended claims.

Although the invention is illustrated and described herein as embodied in of a chair lift and chair lift, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
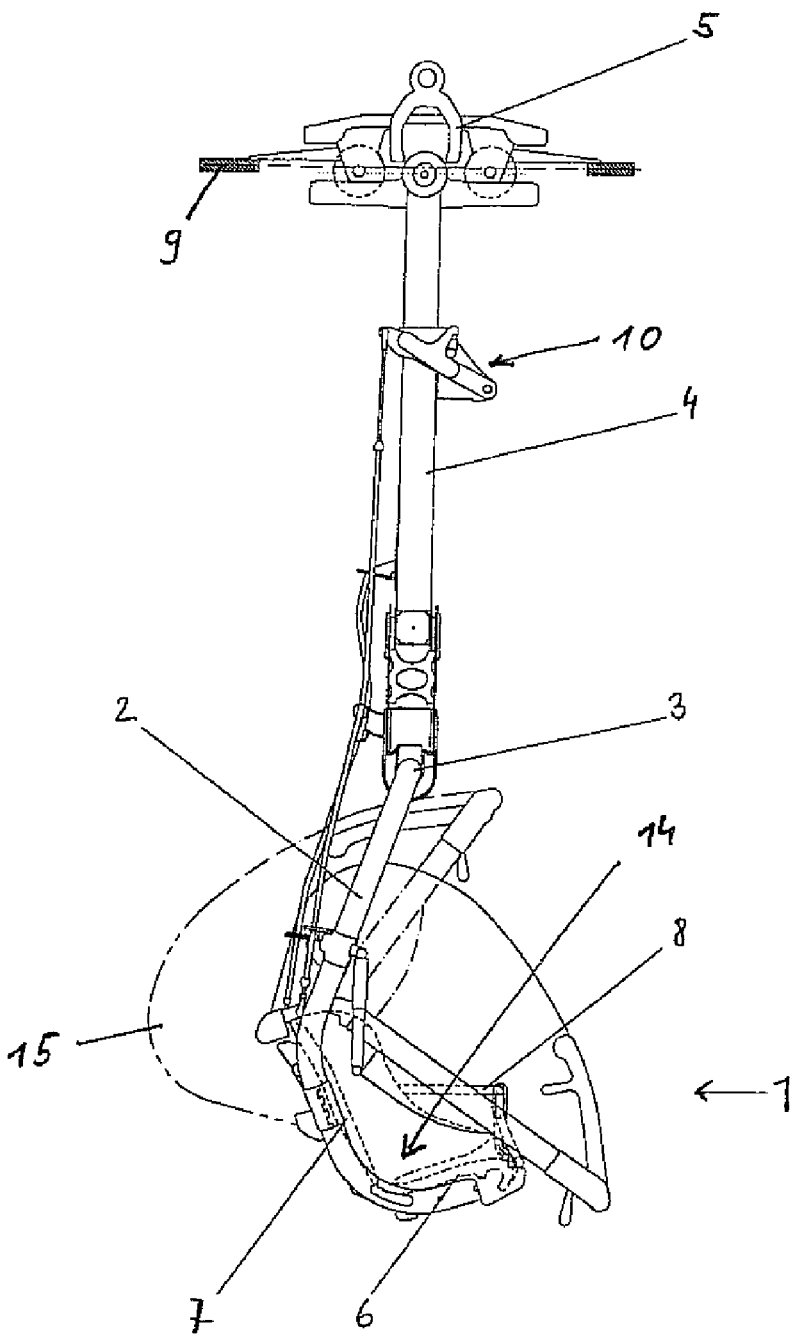
FIG. 1 shows a chair according to the invention in side view.

Referring now to the figures of the drawing in detail and first, particularly, to FIG. 1 thereof, there is shown an embodiment of a chair 1 according to the invention which, as known per se, has a frame 2 that is coupled via a joint 3 with a supporting rod 4 and a clamping device 5 to a traction cable 9. The chair 1 has a plurality of seats 14 which are located next to one another and have a seat surface 6 and a backrest 7. In order to prevent passengers from falling from the chair 1, a safety bar 8 can be moved from an upper and open position (illustrated in FIG. 1) into a lower and closed position (likewise illustrated in FIG. 1). The safety bar 8 can be closed and opened either automatically with the aid of a mechanism 10, which interacts with a device (not illustrated) provided in the stations, or manually by the passengers. In addition, the chair may also have a hood 15.

With the aid of the closed and encircling traction cable 9 (merely indicated in FIG. 1), the chairs 1 are conveyed from a valley station (not illustrated in the drawings), if appropriate via one or more intermediate stations, to a mountain station and back again. In this case, the chairs 1 can either be decoupled from the traction cable 9 and coupled to the latter again in the stations with a clamping device 5, as illustrated by way of example in FIG. 1, or it is also possible for the chairs 1 to be clamped fixedly to the traction cable 9.

Figure 2:
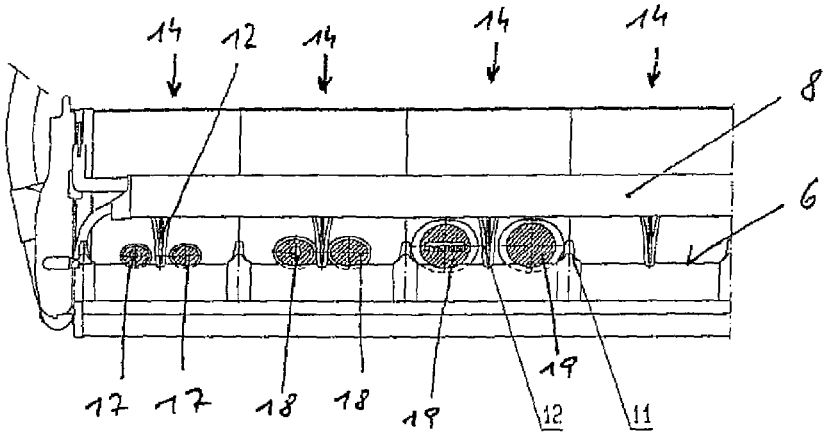
FIG. 2 shows a section from the front of the chair with the safety bar closed.
Figure 3:
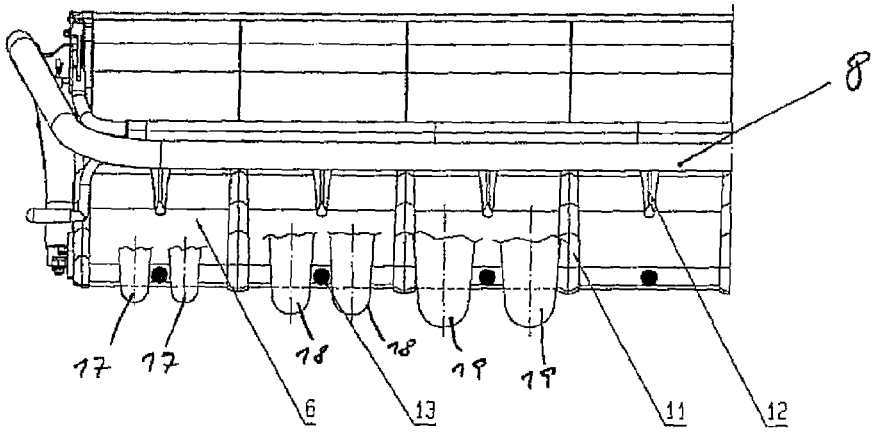
FIG. 3 shows the section from FIG. 2 from above with the safety bar open.

In the closed position of the safety bar 8, a securing part 12, in particular a protective panel, or a cam, extends between the passengers' thighs 17, 18, 19, which are illustrated symbolically in FIGS. 2 and 3, and prevents in particular shorter people, such as children, from slipping through under the safety bar 8. The securing part, which is illustrated in detail in FIGS. 5 to 9, is fastened to the safety bar 8 with the aid of a mounting plate 16.

So that the passengers take up a correct position on the seats 14 and the securing part 12 is also actually located between a passenger's legs, separating elements 11 can be fitted between the seats 14, the separating elements rising over the seat surface 6 of the seats 14 and prompting a correct sitting position of the passengers on the seats 14. The separating elements 11 cause a passenger to notice immediately if he is not sitting correctly in the center of a seat 14, and he can therefore correct his sitting position before the safety bar 8 is automatically or manually closed.

Even if such separating elements 11 are present and, in particular, if they are not present, a securing part 12 may press against a passenger's thigh 17, 18, 19 because said passenger is not sitting correctly on his seat 14 and, when the safety bar 8 is closed, a thigh 17, 18, 19 is entirely or partially located below the securing part 12. Said risk exists in particular if the safety bar 8 is closed automatically. A passenger may also be struck on the head, on the area of the nape of the neck, on the back or on the shoulder by a securing part 12 if he bends forwards just as the safety bar 8 is closing.

In order, in such situations, to avoid such undesirable contact with a securing part 12 being found unpleasant or painful and to avoid the securing part 12 becoming caught on the helmet in the area of the nape of the passenger's neck, the securing part 12 according to the invention comprises a first upper segment or section 20, which is arranged on the safety bar 8, and a second segment, or end section 21. The first upper section 20 has a surface 23, and the end section 21 has a surface 24, both surfaces facing the seat 14 and the passenger. A central section 22 which has a curved surface 25 lying between the surfaces 23 and 24 lies between the upper section 20 and the end section 21. The upper section 20 and the end section 21 are arranged at an angle of less than 180° with respect to each other, as a result of which the two surfaces 23 and 24 that face toward the seat enclose a complementary angle $\alpha'$ of more than 180°. In the exemplary embodiment, the angle $\alpha$ is illustrated with 113°.

Figure 4:
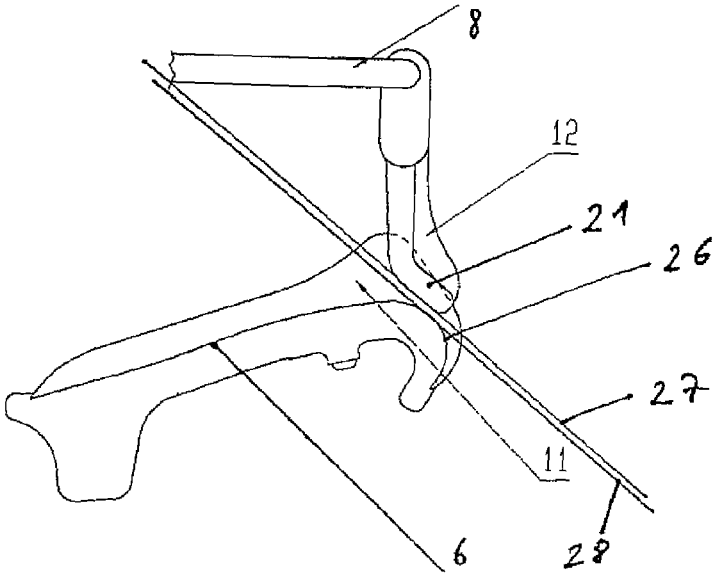
FIG. 4 shows a section through a seat with a securing part according to the invention.

As can best be seen in FIG. 4, the seat surface 6 is rounded downward in the region of a front edge 26. The angled end section 21 of the securing part 12 causes the surface 24 of said end section to lie, in the closed position of the safety bar 8, in a plane 27 lying parallel to a tangential plane 28 of the rounded front edge 26. If the safety bar 8 is not yet entirely in the closed position thereof, for example because it is being closed, the angle of the plane 27 to a horizontal plane or to a plane in which the actual seat region of the seat surface 6 is located is smaller such that, in the event of a collision, the surface 24 strikes with a larger contact surface against a passenger's body part than when the securing part 12 only protrudes straight downwards, as is customary in the prior art.

As can be seen in FIGS. 5 to 9, the securing part 12 has a relatively wide and sharply rounded end 29. In addition, the securing part 12 has a substantially triangular cross-sectional shape which provides the securing part 12 with a high degree of stability, therefore the latter may also be produced from an elastic material, which further reduces the risk of injuries, and also provides large contact surfaces on all sides, should collisions occur from a different side from the side facing the seat 14.

Figure 5:
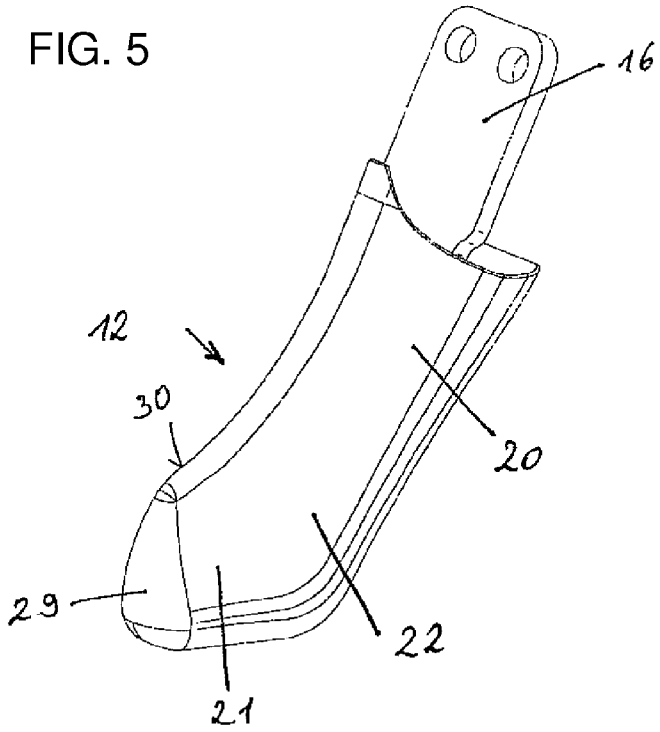
FIG. 5 shows the securing part according to the invention in an oblique view.
Figure 9:
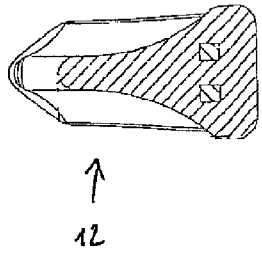
FIG. 9 shows a section through the securing part according to the invention along the line IX-IX in FIG. 6.
Figure 7:
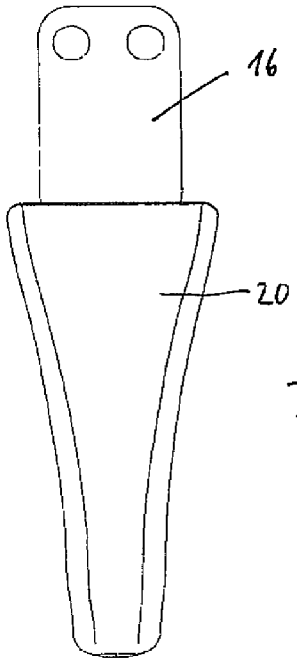
FIG. 7 shows the securing part according to the invention as viewed by the passenger.
Figure 6:
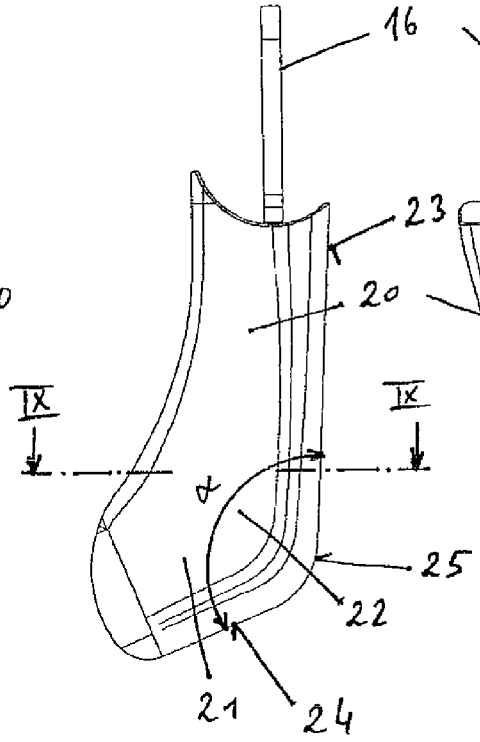
FIG. 6 shows the securing part according to the invention from the side.
Figure 8:
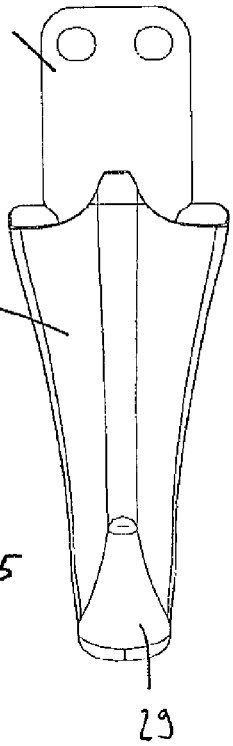
FIG. 8 shows the securing part according to the invention from the opposite side.

It can best be seen in FIGS. 5 and 6 that the end section 21 has a surface 30 lying opposite the surface 24. Within the scope of the invention, the angle between the surfaces 24, 30 of the end section 21 is greater than 10°, and is preferably between 20° and 60°, in particular between 30° and 40°.

In addition, in order to get passengers, in particular children, to spread their legs apart somewhat and to sit down correctly on the seats 14 so that the protective part 12 can easily be arranged between the legs, a central region may be arranged in the region of the front edge 26 of each seat or at least some seats 14, said region differing with regard to its graphical design from the regions arranged laterally thereto. Said central region may be a marking 13, for example a graphic, in particular a picture, a pattern, a logo, for example a company logo, or the like. In a simple embodiment, the marking 13 may constitute a geometrical figure of greater or lesser simplicity (for example a circle, cross, triangle, square, line) which already per se identifies the region to be left free. The marking may also be, for example, a picture of a comic figure or of a mascot in order, in particular, to motivate children to leave said region free by their attention being drawn, at least as they get into the chair 1, to the picture and being prompted to sit down correctly on the seat 14 and to spread their legs apart somewhat.

In a preferred embodiment of the invention, the width of the securing part 12, as measured parallel to the front edge 26 of the seat surface 6, at least in the second end section 21 is identical to or smaller than the width of the marking 13.

In summary, an exemplary embodiment of the invention can be depicted as follows:

A chair of a chair lift having seats 14 with a seat surface 6 has a safety bar 8 which extends transversely over the seats 14 and can be pivoted from an open position into a closed position. Securing parts 12, in particular protective panels, are arranged on the safety bar 8 and, in the closed position of the safety bar 8, extend in the direction toward the center of the front edge 26 of the respective seat surface 6. The securing parts 12 have a first section 20 which is adjacent to the safety bar 8 and is oriented toward the front edge 26, and a second end section 21 which is oriented at an angle ($\alpha$) of less than 180° to the first section 20.

The invention claimed is:

1. A chair of a chair lift, comprising:

a plurality of seats each with a seat surface having a front edge;

a safety bar pivotally mounted between an open position and a closed position wherein said safety bar extends transversely across said seats;

a plurality of securing parts each mounted to said safety bar and, in the closed position of said safety bar, extending in a direction toward a center of said front edge of a respective said seat surface;

said securing parts having a first section adjacent said safety bar and oriented toward said front edge, and a second section distal from said safety bar, bent away from said first section in a forward direction and away from said front edge, and enclosing an angle of less than 180° with said first section.

2. The chair according to claim 1, wherein said securing parts are protective panels.

3. The chair according to claim 1, which further comprises a central section connected between said first section and said second section forming an end section.

4. The chair according to claim 3, wherein said central section is arcuate.

5. The chair according to claim 3, wherein said central section has a kink with rounded edges.

6. The chair according to claim 1, wherein said first section is formed with a first surface facing said seat, and said second section has a second surface facing said seat, and wherein said first surface and said second surface enclose an angle of more than 180° between each other.

7. The chair according to claim 6, wherein said angle between said first surface and said second surface is between 270° and 200°.

8. The chair according to claim 6, wherein said angle between said first surface and said second surface is between 250° and 220°.

9. The chair according to claim 6, wherein said second section has a forward surface opposite said second surface enclosing an angle of greater than 10° therewith.

10. The chair according to claim 9, wherein said second surface and said forward surface enclose an angle between 20° and 60°.

11. The chair according to claim 10, wherein said angle between said second surface and said forward surface lies between 30° and 40°.

12. The chair according to claim 1, wherein said front edge of said seat surface is rounded, and said second section is oriented, at least in some portions, parallel to a tangential plane of said front edge.

13. The chair according to claim 1, wherein said front edge of said seat surface is rounded, said surface of said second section facing toward said front edge is curved, and a tangential plane of said curved surface of said second section is oriented parallel to a tangential plane of said front edge.

14. The chair according to claim 1, wherein said securing part has a wider surface facing said seat, and a cross-sectional shape of said securing part becomes narrower away from said surface facing said seat.

15. The chair according to claim 1, wherein a length of said first section is approximately twice a length of said second end section.

16. The chair according to claim 1, which comprises a mounting plate for fastening said securing part to said safety bar disposed as an extension of said first section.

17. The chair according to claim 1, which comprises separating elements projecting above a level of said seat surfaces and disposed between said seat surfaces.

18. The chair according to claim 1, wherein said seat surface has, at a front edge thereof, a central region that differs with regard to a graphical design thereof from laterally adjacent regions.

19. The chair according to claim 18, wherein said central region of said seat surface, in the region of said front edge thereof, is a graphic.

20. The chair according to claim 19, wherein said graphic is a picture, a pattern, or a marking.

21. The chair according to claim 18, wherein a width of said securing part, as measured parallel to said front edge of said seat surface, at least on said second section is equal to or smaller than a width of said central region of said seat surface in the region of said front edge thereof.

22. The chair according to claim 1, wherein a free end of said second section forming the end section has a substantially rounded end.

23. A chair lift, comprising:

a valley station, a mountain station, and a traction cable circulating between said valley station and said mountain station; and a plurality of chairs, each according to claim 1, connected permanently or to be coupled to said traction cable for transporting persons between said valley station and said mountain station.

* * * * *